United States Patent [19]

Kratz et al.

[11] Patent Number: 4,642,427

[45] Date of Patent: Feb. 10, 1987

[54] CONTACT ARRANGEMENT

[76] Inventors: Christer Kratz; Åke Engström; Göran Karlsson, all of Nyänshammm, Sweden

[73] Assignee: Televerkets Huvredrontor, Farsta, Sweden

[21] Appl. No.: 757,838

[22] PCT Filed: Oct. 8, 1984

[86] PCT No.: PCT/SE84/00330

§ 371 Date: Jul. 16, 1985

§ 102(e) Date: Jul. 16, 1985

[87] PCT Pub. No.: WO85/02299

PCT Pub. Date: May 23, 1985

[30] Foreign Application Priority Data

Nov. 16, 1983 [SE] Sweden ..... 8306311

[51] Int. Cl.[4] ..... H01H 15/06; H01H 1/16

[52] U.S. Cl. ..... 200/16 C; 200/277

[58] Field of Search ..... 200/16 C, 16 D, 16 R, 200/11 G, 11 J, 11 K, 11 DA, 277, 292

[56] References Cited

U.S. PATENT DOCUMENTS

| | | | |
|---|---|---|---|
| 2,521,468 | 9/1950 | Lodge | 200/16 C |
| 3,592,983 | 7/1971 | Kroll et al. | 200/292 X |
| 3,639,708 | 2/1972 | Wolniak et al. | 200/277 X |
| 4,016,401 | 4/1977 | Delaage | 200/16 C |

*Primary Examiner*—J. R. Scott

*Attorney, Agent, or Firm*—Pollock, Vande Sande & Priddy

[57] ABSTRACT

A switch for use in a printed circuit board having printed circuits on a surface (1*a*) thereof. One or several contact rollers (6, 7, 8) are adapted in a slider (4) for movement relative to the surface (1*a*) in such a way that the rollers interact with the printed circuit strips for closing and interrupting electrical circuitry connected to the printed circuit strips in dependence of the position of the slider.

3 Claims, 5 Drawing Figures

CONTACT ARRANGEMENT

FIELD OF THE INVENTION

The present invention relates to a slide switch arranged on a circuit board having printed circuits or printed strips on a surface thereof.

BACKGROUND OF THE INVENTION

Contact arrangements suitable for use in conjunction with printed circuit boards have previously been disclosed. Thus, for example, spring members which are forced down manually against electrically conductive strips and into contact with the strips have been disclosed. When the manual force ceases to be applied, the aforementioned contact will also cease. Also previously disclosed is an arrangement of switching members which, subject to the application of force, will present the aforementioned spring members for the purpose of establishing the aforementioned contact and/or for interrupting the contact. Also the use of groups of springs with contact springs on the circuit board has been proposed.

SUMMARY OF THE INVENTION

Technical Problem

There exists a need in conjunction with contact arrangements of this kind to be able to produce them with small dimensions and with accurate and well defined positions for the contacts in question. It is also desirable for the contact arrangement to be so constructed as to provide the contact interaction directly on the circuit board.

There also exists a need for a contact arrangement to be capable of being constructed so that small frictional losses and thus a minor tendency to wear will occur during the application of the forces for establishing contact.

Solution

The present invention has as its principal object the presentation of an arrangement which will solve the problem outlined in the above. What may principally be regarded as being characteristic of the novel contact arrangement is that one or more contact rollers are so arranged as to be capable of movement relative to the printed surface in such a way that each roller is capable of interacting with the circuits so as to close, or open, depending on the positional displacements of the contact roller between parts of the circuit.

In a preferred embodiment each roller is constructed with two roller contact paths which are connected together by means of a shaft. Preferably each roller contact path is allocated its own printed line on the contact surface.

In a preferred embodiment each contact roller is also so arranged as to be capable of movement along a straight path over the card surface in question. Preferably each roller contact path is allocated a printed strip including a straight part which coincides with the straight path of the roller contact path. Each printed strip can be so arranged as to exhibit an angled section near its own straight part. Similarly each straight part can be provided with one or mroe interruption sections. Furthermore one or more straight parts can start and/or end at different distances from one of the edges of the card, and different straight parts which belong to different circuits can form part of one and the same path.

Each strip on the card is connected to an external line, while the contact-establishing, contact-switching and/or contact-interrupting roller should preferably not be connected to any external line.

In a preferred embodiment the contact rollers are mounted on a slide so arranged that the contact rollers interact with the aforementioned circuits by the application of pressure. The slide can in this case be arranged inside a slide housing which is provided with a part extending over the surface of the card. The slide in this case has a member capable of interacting with the under surface of the aforementioned part which applies the aforementioned pressure.

Advantages

The use of the novel contact arrangement enables the contact roller or contact rollers to be moved over the printed circuits on a card, and the same contact roller can be used to close and interrupt plural strips without itself required to be connected to a specific strip. The contact roller also differs from the previously disclosed contact rollers in that it rolls against the contact surface of the aforementioned printed circuits.

The novel contact arrangement can replace the previously disclosed groups of springs with contact springs. The actual switching operation takes place by the contact rollers functioning as movable bridging contacts. The contact rollers act directly upon the printed circuits, and the pattern of the latter determines the switching events.

BRIEF DESCRIPTION OF THE DRAWINGS

A preferred embodiment of a contact arrangement exhibiting the significant characteristic features of the invention is described below with simultaneous reference to the accompanying drawing, in which.

DESCRIPTION OF THE PREFERRED EMBODIMENT

Figure 1:
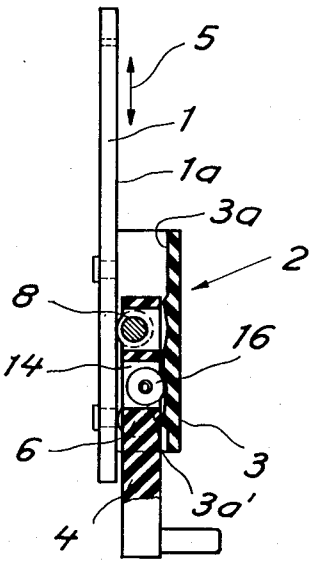
FIG. 1 is a side view partially in cross-section of the slide switch according to the invention.
Figure 2:
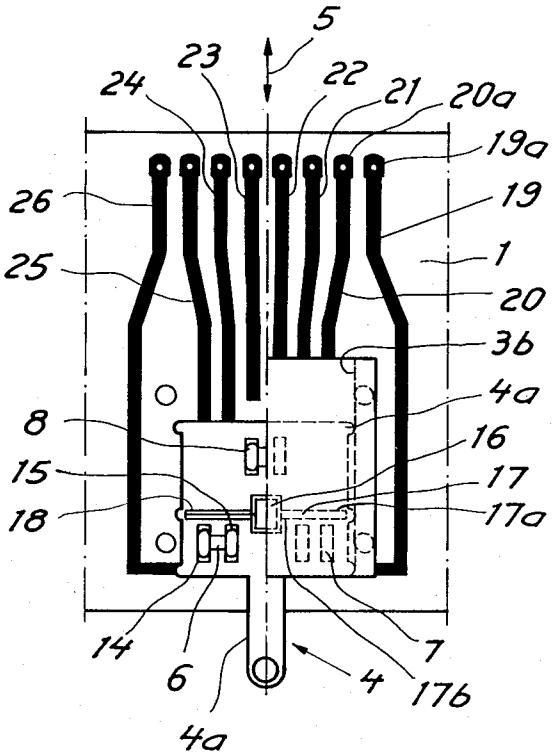
FIG. 2 is a plan view of the slide switch according to FIG. 1.
Figure 3:
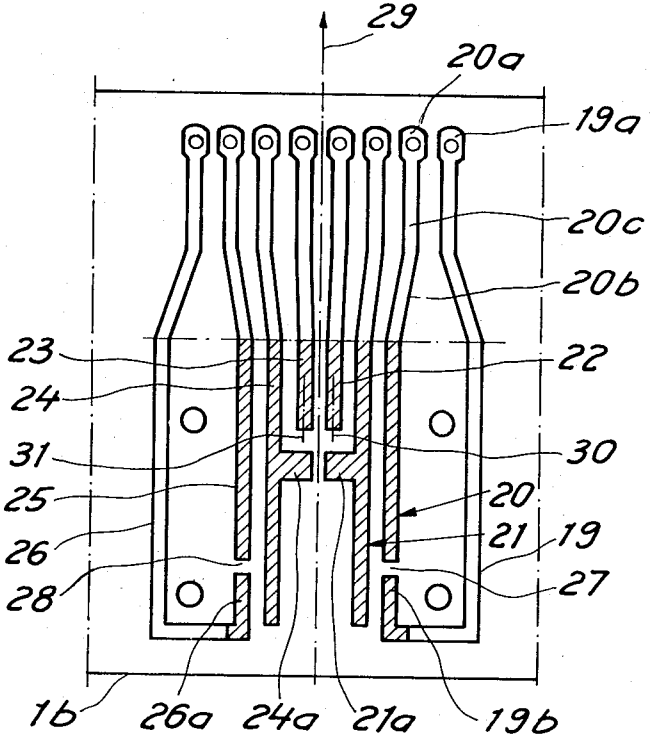
FIG. 3 is a plan view of printed strips on a circuit board.

In FIGS. 1 and 2 a printed circuit board with printed wiring or printed circuits is indicated by the reference numeral 1. The circuit board can be of the previously disclosed kind in which the printed circuits are arranged in a desired pattern according to the invention. The novel slide switch arrangement is indicated by the reference designation 2 and is applied to the first side 1*a* of the card. The switch comprises a housing with a cover portion 3 which extends above the aforementioned side 1*a* of the card, towards which the inner surface 3*a* of the cover portion faces against said slide 1*a*. A slide member 4 is preferably capable of movement along a straight path, and the directions of movement are indicated by arrows 5 and 29.

The slide member has one or more contract rollers, and three contact rollers 6, 7 and 8 are shown in the preferred embodiment. The contact rollers are supported in bearings on the slide member 4 and are arranged so as to contact circuit strips 19–26 on the circuit board as the slide member 4 is displaced across the surface 1*a* of the card.

Figure 4:
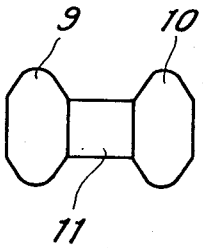
FIG. 4 is a side view of a contact roller.
Figure 5:
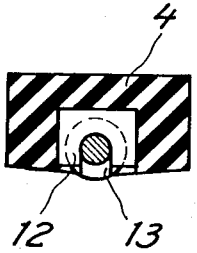
FIG. 5 is a schematic sectional view showing the support of a contact roller in the housing according to FIG. 4.

The construction of each contact roller and the support thereof in the bearings are shown in the FIGS. 4 and 5. Each contact roller exhibits two roller portions 9 and 10 which contact the printed wiring on the surface of the card as the contact rollers roll over the surface of the circuit board. The roller portions 9 and 10 are interconnected via a shaft portion 11. The shaft portion 11 is journalled in the slide 4, and slide 4 is provided with a downward-facing, disc-shaped component 12, which is provided with a hole or slit 13 for the axle portion. The disc-shaped component 12 may have a contact surface with the axle portion having a transverse extension.

The slide member 4 is also provided with through holes 14, 15 in which said roller portions 9 and 10 may freely rotate.

The slide member 4 also supports a pressure roller 16 which is biased by a spring against the inner surface 3*a* of the cover portion 3. The bias is by means of spring elements 17, 18 which are supported at their first ends 17*a* by the slide member and are supported at their other ends 17*b* by the roller 16. The spring elements 17 and 18 may alternatively be constructed in the form of a single spring which extends through the roller 16 at the central part thereof and is supported by the slide member 4 at its outer ends. The spring consists of a piano wire which is pre-tensioned. The spring element or the spring elements is/are so arranged that the contact rollers 6,7,8 are forced, as the slide member moves across the surface 1*a* of the card, against the printed strips on the circuit board which is represented in the embodiment shown by printed strips 19, 20, 21, 22, 23, 24, 25 and 26. The inner surface 3*a* of the cover portion 3 is provided with arcuate recesses 3*a*'arranged as to ensure that a varying pressure is applied by the contact rollers against the printed strips of the surface *1a* of the board as the slide member moves or rolls over the surface 1*a* of the card in order the define separate switch positions for the slide member.

The slide member has lateral guide members 4*a* which are positioned adjacent inner side wall 3*b* of the housing 3. The slide member has six such guide members, four of which are positioned preferably at the four corners of the slide member. The slide member in the embodiment shown here has a quadrangular, for example rectangular or square, horizontal cross section. One side of the slide member is provided with a projecting shaft 4*b*. The aforementioned slide member may be capable of manual or automatic operation either directly or indirectly by means of operating elements not shown here.

The different contact rollers are not directly connected to any external wires, but preferably serve purely as contact members for the closing, or opening of contacts on the board. The printed lines 19–26, on the other hand, may be connected to external members, for example wires via connectors 19*a*, 20*a*, etc.

The printed strips are allocated in pairs to the contact rollers 6, 7 and 8. Thus the lines 20 and 21 are allocated to the contact roller 7, the lines 22 and 23 are allocated to the contact roller 8, and the lines 24 and 25 are allocated to the contact roller 6. The lines 19 and 26 are also so arranged in the embodiment shown as to form, together with the components 19*b* and 26*a* pairs with corresponding components of the lines 21 and 24. The components 19*b* and 26*a* are arranged along the same straight path as the components of the lines 20 and 25. Interruption sections 27 and 28 separate the lines 19 and 26 from the lines 20 and 25. The lines 21 and 24 are also provided with angled sections 21*a* and 24*a*. The lines are thus of different lengths, and end and start at different distances from the edge 1*b* of the card. Thus, for example, the lines 22 and 23 start after the angled sections 21*a* and 24*a* seen from the edge 1*b* of the card. The lines exhibit on the one hand straight sections which follow the paths along which the roller contact portions 9 and 10 of the contact rollers are moved. The lines also include sections which deviate from the aforementioned displacement path for the slide. The sections 20*b*, 20*c* can be mentioned as being typical of such sections.

Upon displacement of the slide member 4 from the position in accordance with FIG. 1, the following contacts will occur in the typical embodiment illustrated here. In the initial position, the roller 6 will make contact between the lines 24 and 26, and the roller 7 will make contact between the lines 19 and 21. The roller 8 in this case is not in contact with any line at all. Upon being displaced in the direction of the arrow 29 the rollers 6 and 7 will, after having moved across the interruption positions 27 and 28, cause interruption to occur between lines 24 and 26 and lines 19 and 21 and will instead cause contact to be established between lines 24 and 25 and lines 20 and 21. At the position of the angled sections 21*a* and 24*a* the roller 8 will make contact with the angled sections and will establish an electrical connection between the lines 21 and 24. Beyond the angled sections 21*a* and 24*a* there are two interruption positions 30 and 31 which the roller 8 will pass before it interacts with and establishes contact between the lines 22 and 23. The contacts will occur in the reverse sequence with the slide moving in the opposite direction. It is assumed that the lines can be routed and arranged in a manner other than that illustrated here, and that in this way different contact events can be performed as desired.

The number of rollers may be varied, as may the number of roller contact portions for each roller.

The invention is not limited to the embodiment described above by way of example, but may be modified within the scope of concept and the following.

We claim:

1. A switch for making electrical contacts between electrical circuit strips on a circuit boarding comprising:

electrically conductive strips arranged in a predetermined pattern on said circuit board, portions of said strips extending in pairs in parallel in a first direction within a switching area for providing fixed switching contacts of said switch;

an essentially U-shaped housing attached to said circuit board comprising wall portions and a cover portion extending above said switching area and offset a predetermined distance above said circuit board for defining a space essentially rectangular in cross-section and being opened in said first direction;

a slide member dimensioned to fit inside said housing between the housing and the circuit board for movement in said first direction;

said slide member containing a plurality of contact members, each of said contact members comprising a first and a second contact rolelr integrally interconected by a shaft portion for forming said contact member;

each of said contact members being supported by said slide member via said shaft portion for being pivotable during the movement of the slide member in said first direction and each of said contact rollers being positioned immediately above and containing a corresponding circuit strip, each contact member forming an electric circuit from a first circuit strip to the first contact roller, thence through said shaft portion to the integrally connected second contact roller and finally to a second circuit strip;

said contact members being arranged in at least two rows offset in said first direction for supporting said slide member by the contact of said contact members and said circuit board;

said slide member including a biasing means for biasing said slide member towards said circuit board and each contact member into contact with the corresponding circuit strip, said biasing member being positioned between said rows of contact members;

said slide member being movable in said first direction for causing said contact members to pivot and roll over said circuit strips for opening and closing electric circuits in dependence of the pattern of said circuit strips;

each shaft portion being perpendicular to said first direction and constituting first guiding means for guiding said slide member in said first direction during the movement of said slider and preventing deviations from said first direction;

said wall portion of said housing forming second guiding means for preventing lateral deviations of the slide member from said first direction.

2. A switch as claimed in claim 1, wherein:

said cover portion is provided with arcuate portions in the surface thereof facing the circuit board;

said biasing member comprising a biasing roller and at least one spring element; and, said arcuate portions cooperate with said biasing roller for providing a means for separating different switch positions of said slider in the longitudinal direction.

3. A switch as claimed in claim 1 or 2 wherein the circuit board is a printed circuit board.

* * * * *

UNITED STATES PATENT AND TRADEMARK OFFICE

CERTIFICATE OF CORRECTION

PATENT NO. : 4,642,427

DATED : February 10, 1987

INVENTOR(S) : Kratz et al

It is certified that error appears in the above-identified patent and that said Letters Patent are hereby corrected as shown below:

Please correct the spelling of the Assignee on the first page of the patent to

--Televerkets Huvudkontor--.

Signed and Sealed this

Eleventh Day of August, 1987

*Attest:*

DONALD J. QUIGG

*Attesting Officer*

*Commissioner of Patents and Trademarks*